US007048641B2

(12) United States Patent
Cowup

(10) Patent No.: US 7,048,641 B2
(45) Date of Patent: May 23, 2006

(54) GOLFING AIDS

(76) Inventor: John Henry William Cowup, 105 Hamlet Court Road, Westcliff-on-Sea, Essex (GB) SS0 7ES ( * ) Notice: Subject to any disclaimer, the term of this patent is extended or adjusted under 35 U.S.C. 154(b) by 0 days.

(21) Appl. No.: 10/510,414

(22) PCT Filed: Feb. 28, 2003

(86) PCT No.: PCT/GB03/00848

§ 371 (c)(1),
(2), (4) Date: Oct. 6, 2004

(87) PCT Pub. No.: WO03/074136

PCT Pub. Date: Sep. 12, 2003

(65) Prior Publication Data

US 2005/0143185 A1 Jun. 30, 2005

(30) Foreign Application Priority Data

Mar. 1, 2002 (GB) ..... 0204866.8
Sep. 13, 2002 (GB) ..... 0221247.0

(51) Int. Cl.
*A63B 69/36* (2006.01)

(52) U.S. Cl. ..... 473/268; 473/266; 473/269

(58) Field of Classification Search ..... 473/266–278
See application file for complete search history.

(56) References Cited

U.S. PATENT DOCUMENTS

| | | | | |
|---|---|---|---|---|
| 4,143,877 | A | 3/1979 | Jeffries | |
| 4,181,307 | A | 1/1980 | Krene et al. | |
| 4,383,687 | A | 5/1983 | Wolff | |
| 4,483,536 | A * | 11/1984 | Mitchell | 473/268 |
| 4,789,159 | A | 12/1988 | Kane | |
| 5,116,058 | A * | 5/1992 | Theriault | 473/268 |
| 5,375,844 | A | 12/1994 | Waud | |
| 5,951,409 | A | 9/1999 | Calley | |

FOREIGN PATENT DOCUMENTS

| | | |
|---|---|---|
| GB | 430844 | 6/1935 |
| GB | 2 269 755 | 2/1994 |
| GB | 2 292 892 | 3/1996 |
| GB | 2 308 070 | 6/1997 |
| WO | WO 82/03018 | 9/1982 |
| WO | WO 00/06261 | 2/2000 |

* cited by examiner

*Primary Examiner*—Nini F. Legesse
(74) *Attorney, Agent, or Firm*—Davis & Bujold, P.L.L.C.

(57) ABSTRACT

An aid for visual detection of a golfer's head movement, constructed of card or plastics sheet includes a black-faced sighting member that has a circular aperture there through and is hinged to a base member Adjustment of the inclination of the sighting member to the base member brings a black disc-marking line sight through the aperture. Lugs of a stay member which is hinged to the sighting member for setting the sighting-member inclination are held engaged in selected notches of the base member by a sprung-up tongue; in an alternative form of aid a stay member engages in transverse slots. Head movement is observed as apparent movement of the disc-marking within the aperture.

15 Claims, 3 Drawing Sheets

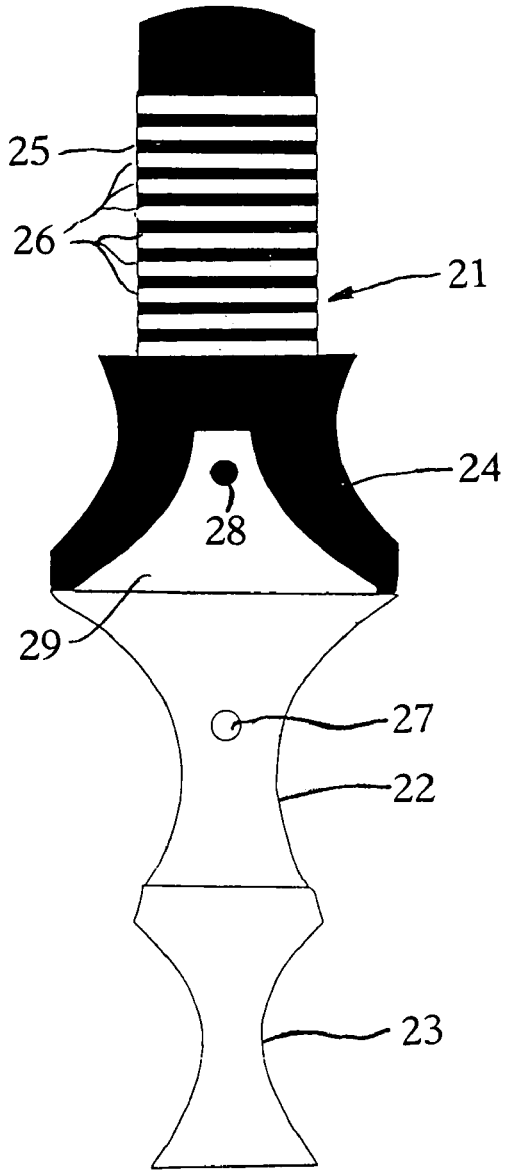
Fig. 4
Fig. 5
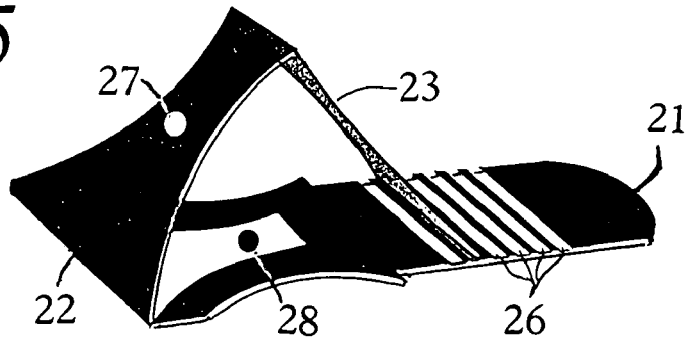

GOLFING AIDS

This application is a national stage completion of PCT/GB03/00848 filed Feb. 28, 2003 which claims priority from British Application Serial Number 0204866.8 filed Mar. 1, 2002 and British Application Serial Number 0221247.0 filed Sep. 13. 2002.

FIELD OF THE INVENTION

The present invention relates to a golfing aids.

BACKGROUND OF THE INVENTION

The invention is concerned in particular with aids for assisting golfers in improvement or correction of the swing of a golf-club in teeing off or otherwise. There is general agreement in golfing that the accuracy of driving a golf ball from the tee or elsewhere is dependent on the golfer maintaining his/her head still throughout execution of the swing of the golf club. It is one of the objects of the present invention to provide a golfing aid that may be used to assist a golfer in detecting head movement during his/her swing whether in practice or play.

SUMMARY OF THE INVENTION

According to one aspect of the present invention there is provided a golfing aid wherein a sighting member having an aperture therein is mounted on a base member for inclination to the base member in defining a line of sight through the aperture to a reference marking on the base member such that a golfer viewing the marking through the aperture can detect movement of his/her head by observing apparent movement of the marking within the aperture.

The aperture in the sighting member may be circular, and in these circumstances, the reference marking on the base member may also be circular for alignment in the line of sight with the circular aperture of the sighting member.

The marking on the base member may be of dark colour (for example black) against a visually-contrasting background. The upper surface of the sighting member, or at least such part of the surface as provides a margin to the aperture, may also be of the dark colour. In these latter circumstances, and with correct alignment of the marking with the aperture in the golfer's line of sight, the marking and the surrounds to the aperture will merge into one another visually, without any of the background to the marking showing, or with just a narrow ring of it showing contrastingly; movement of the golfer's head will be accompanied, and readily recognised visually, by change from this condition.

The sighting member, which may have the form of a regular trapezium (that is to say, a quadrilateral having a pair of parallel sides of unequal length and a pair of non-parallel sides of equal length), may be hinged to the base member such that its inclination to the base member is adjustable to allow for variation of the inclination of the line of sight. A stay member hinged to the sighting member and engageable with the base member, may be used for setting and adjusting the inclination of the sighting member.

BRIEF DESCRIPTION OF THE DRAWINGS

Two forms of golfing aid in accordance with the present invention will now be described, by way of example, with reference to the accompanying drawings, in which:

FIG. 4 is a plan view to reduced scale, of the second form of golfing aid according to the invention when in a collapsed, flat-sheet condition; and FIG. 5 is a perspective view to the reduced scale, of the golfing aid of FIG. 4, when erected ready for use.

DETAILED DESCRIPTION OF THE PREFERRED EMBODIMENTS

Figure 1:
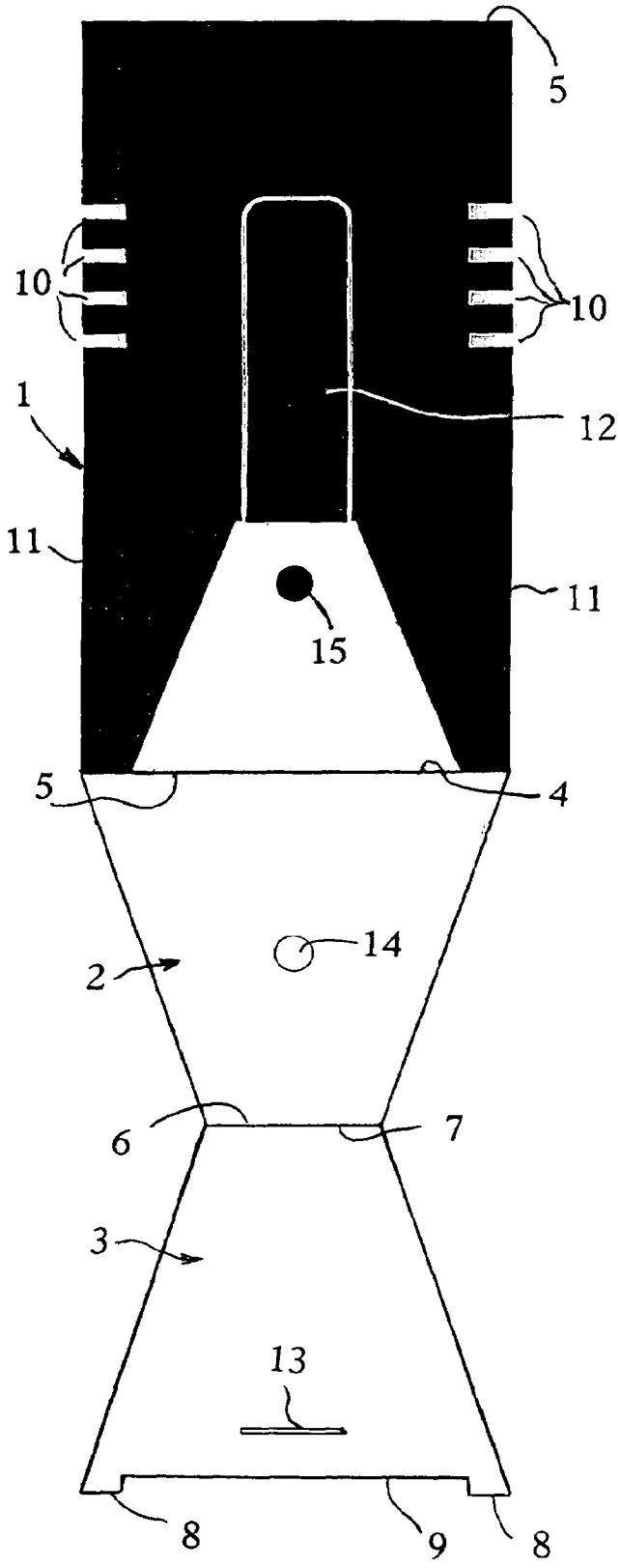
FIG. 1 is a plan view of a first form of the golfing aid according to the invention when in a collapsed, flat-sheet condition prior to its erection for use.
Figure 2:
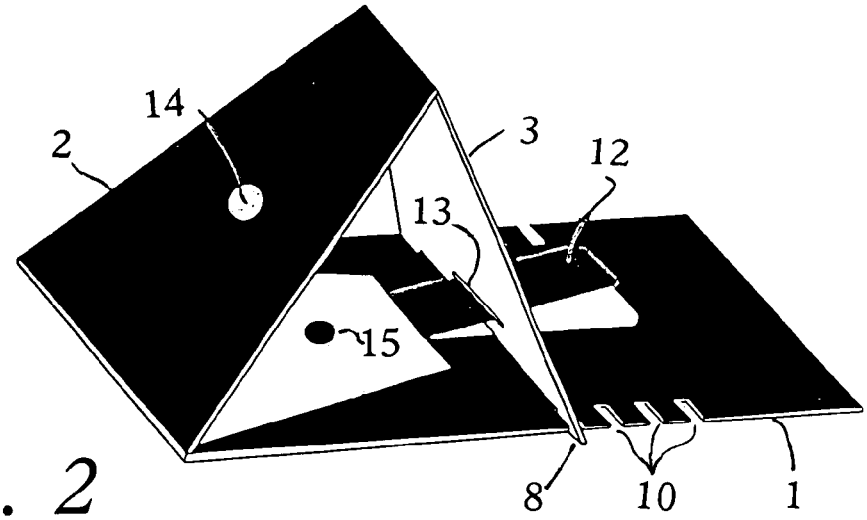
FIG. 2 is a perspective view of the golfing aid of FIG. 1, erected ready for use.

Referring to FIGS. 1 and 2, the first form of golfing aid, which is constructed in one piece of flat plastics sheet or stiff card, has three successive sections that define respectively, an elongate rectangular base member 1, a sighting member 2 hinged to the base member 1, and a stay member 3 hinged to the sighting member 2; the hinging may be by unitary hinges formed simply by bends in the sheet or card. The member 2 is of regular-trapezium form, and is hinged at its base or longer parallel-side 4 to one of the shorter sides 5 of the base member 1. This enables the member 2 to be pivoted up out of the plane of the base member 1 for erecting the aid (as illustrated in FIG. 2) with the member 2 inclined upwardly from the base member 1, so that the members 2 and 3 define respective sides of a triangle having its base defined by the member 1

The stay member 3, which is also of regular-trapezium form, is used to set the inclination of the sighting member 2 in the erected aid. In this regard, the member 3 is hinged by its shorter parallel-side 6 to the shorter parallel-side 7 of the sighting member 2, and has lugs 8 that project from either end of its longer parallel-side 9 for engagement with respective notches 10 in the longer sides 11 of the base member 1. There is a series of four notches 10 spaced from one another along each side 11 to allow any of four possible settings of the inclination angle of the sighting member 2 to be selected.

The lugs 8 are held in engagement with the notches 10 of the selected setting by virtue of the resilience of a tongue 12 that projects through a slot 13 in the stay member 3. The tongue 12 is cut out from the material of the base member 1 and during erection of the aid is lifted up out of the plane of the base member 1 so that it enters and then projects through the slot 13 as the stay member 3 is hinged down from the member 2. The tongue 12 exerts a spring bias on the stay member 3 urging it downwardly to hold the lugs 8 in the engaged notches 10 resiliently. The lugs 8 can be disengaged and re-engaged with different notches 10 in changing the selection of inclination angle of the sighting member 2, simply by lifting the tongue 12 with the fingers and then releasing it once the lugs 8 have been aligned with the notches 10 appropriate to the new selection.

Figure 3:
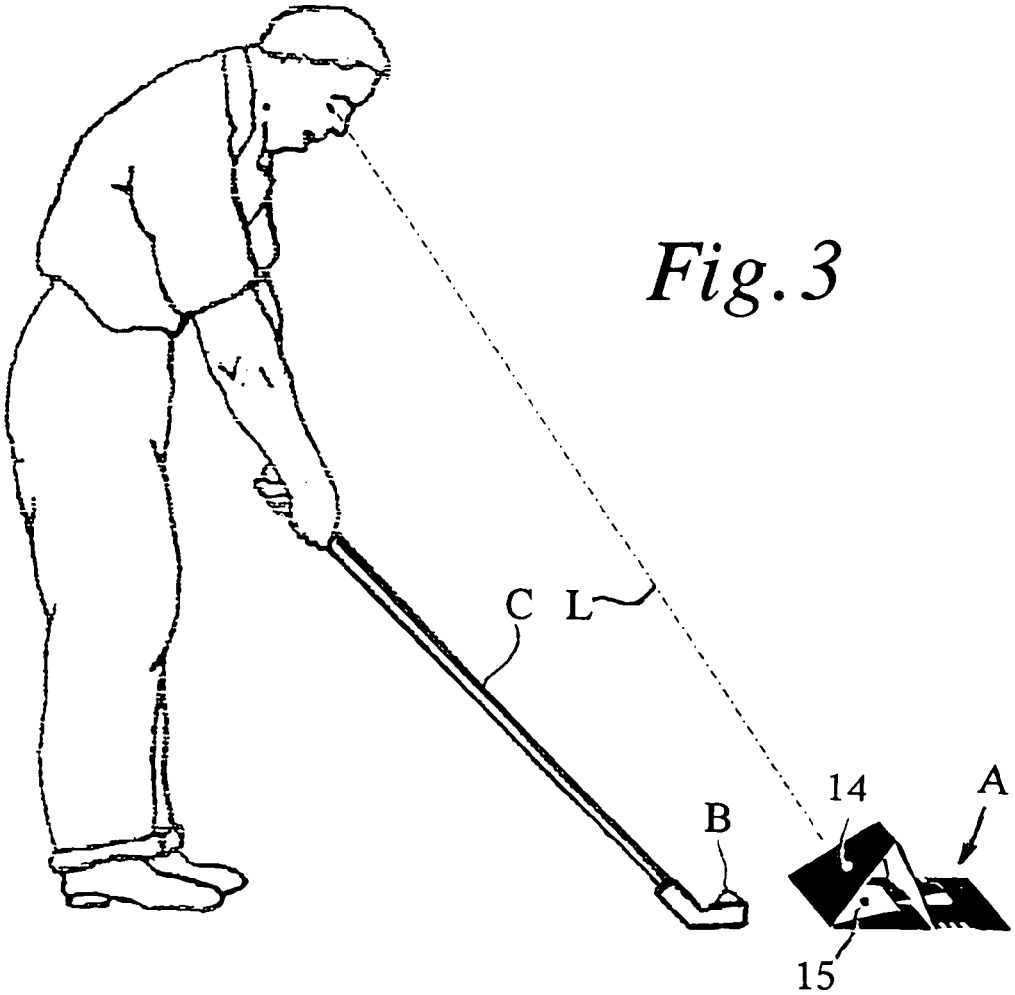
FIG. 3 is illustrative of use of the golfing aid of FIGS. 1 and 2.

When the golfer wishes to make use of the aid of FIGS. 1 and 2, he/she erects it and places it, as illustrated at A in FIG. 3, to one side of the ball B (the particular side depends on whether the golfer is left- or right-handed) so that when he/she addresses the ball B for a strike, the ball B lies between the aid A and the golfer. The aid A is placed on the ground with its base member 1 extending lengthwise substantially at right angles to the desired path of the ball B, and with its sighting member 2 sloping upwardly away from the golfer. The golfer in taking up his/her stance over the ball B, ready to execute swing of the golf-club C, looks towards a circular aperture 14 in the sighting member 2. More particularly, the golfer holds a small disc or dot marking 15 on the base member 1 in his/her line of sight L through the aperture 14. It may be necessary, depending on the height of the golfer, his/her stance and the spacing of the aid A from him/her, to adjust the inclination of the sighting member 2 and/or the spacing, to facilitate this.

Once the golfer has a settled stance, his/her objective should be to maintain the marking 15 centrally of the aperture 14 during movement of the club C both backwards and forwards, and in this way to maintain his/her head still throughout the whole of the swing. Assistance to the golfer in achieving this objective, and more especially in detecting any deviation from it during the swing (for immediate correction and/or subsequent remedial practice), is realised by he/she observing whether there is any apparent movement of the marking 15 within the aperture 14 during the swing. Such movement signifies movement of the golfer's head, and the direction of it indicates the direction of the head movement.

Detection of apparent movement of the marking 15 within the aperture 14 is facilitated by visual contrast in that the marking 15 is (in this example) black on a white background, and the upper surface of the sighting member 2 exposed to the golfer is of the same colour, black. When the marking 15 is correctly aligned with the aperture 14 in the golfer's line of sight L, there will be either none of the white background showing within the aperture 14, or, depending upon the spacing of the aid A from the golfer, just a narrow ring of it encircling the disc-marking 15. Movement of the golfer's head from this condition will accordingly be accompanied by the appearance of, or an increase in, a showing of white in his/her line of sight L through the aperture 14. The amount and sense of the visual change are indicative of the extent and direction of head movement.

The aid A may take the alternative, second form illustrated in FIGS. 4 and 5. As with the first form of FIGS. 1 and 2, the second form is constructed of flat plastics sheet or stiff card, but with, in this case, a base member 21, a sighting member 22 hinged to it, and a stay member 23 hinged to the sighting member 22, each configured (with curvilinear outline) differently from the respective member 1 to 3 of the first form of aid. More especially in this regard, the base member 21 has a head portion 24 with a rearwardly-extending tail portion 25. The tail portion 25 has a series of ten parallel, transverse slots or notches 26 any one of which is engageable by the free end of the stay member 23 in setting the inclination of the sighting member 22.

The second form of aid when erected, is used in the same way as the aid described with reference to FIGS. 1 and 2. In this respect, a circular aperture 27 in the sighting member 22 is used for viewing a disc or dot marking 28 on the base member 21. The marking 28 is black on a visually-contrasting, white area 29 of the head portion 24, and the upper surface of the member 22 is also black. Accordingly, while the golfer holds the marking 28 in his/her line of sight through the aperture 27, his/her head will remain stationary. Movement of the golfer's head, however, results in a readily-detectable apparent-movement of the marking 28 within the aperture 27 corresponding to the head-movement.

The golfing aid of the present invention is of simple construction enabling it to be produced economically. Moreover, the hinged form of construction adopted for the golfing aids of FIGS. 1 and 2 and FIGS. 4 and 5, enables them to be collapsed to a compact configuration for carrying and storage, and to be readily erected to a sturdy triangular configuration for use.

In one realisation of the aid of FIGS. 4 and 5, constructed of white card having one face coloured black and a thickness of 1 mm, the base member 21 has a length of 160 mm, and a maximum width of 90 mm at its hinging with the sighting member 22. The sighting member 22 (of length 80 mm) and the stay member 23 (of length 75 mm) fold down flat onto the base member 21 about this hinging. The base member 21 is a back-to-back laminate of the card with the top layer cut out to provide the notches 26 and white area 29, so that with the single-thickness sighting member 22 and stay member 23 folded down flat onto the base member 21, the overall dimensions of the collapsed aid are: length 160 mm, width 90 mm and thickness 3 mm.

The golfing aid of FIGS. 1 and 2 may be realised in a manner corresponding to that described above for the aid of FIGS. 4 and 5, with the same dimensioning and using the same principles of construction.

The invention claimed is:

1. A golfing aid for assisting a golfer to detect head-movement during swing of a golf club, the golfing aid comprising:

(a) a base member having a background area and a reference marking located within the background area; and (b) a sighting member mounted on the base member for inclination to the base member, the sighting member having an upper surface for viewing by the golfer, the upper surface including a colored region having an aperture therein, and the aperture extending through the sighting member to define a line of sight through the aperture to the reference marking within the background area of the base member;

wherein the reference making is of a first color, the colored region of the upper surface of the sighting member is of the first color, and the background area of the base member is of a second color that is visually-contrasting to the first color to enable the golfer to detect head-movement by observing apparent movement of the second color in the aperture of the sighting member.

2. The golfing aid according to claim 1, wherein the aperture is a circular aperture in the colored region of the upper surface of the sighting member.

3. The golfing aid according to claim 1, wherein the reference marking is a circular marking located within the background area of the base member.

4. The golfing aid according to claim 1, wherein the first color is darker than the second color.

5. The golfing aid according to claim 1, wherein the first color is black.

6. The golfing aid according to claim 1, wherein the second color is white.

7. The golfing aid according to claim 1, wherein the base member and the sighting member are each of sheet form.

8. The golfing aid according to claim 1, including selectively-adjustable means for selective adjustment of inclination of the sighting member relative to the base member to vary inclination of the line of sight.

9. The golfing aid according to claim 8, wherein the sighting member is hinged to the base member.

10. The golfing aid according to claim 9, further includes a stay member hinged to the sighting member, the stay member being engageable with the base member for setting inclination of the sighting member relative to the base member, engagement of the stay member with the base member being selectively variable for varying the inclination of the sighting member relative to the base member.

11. The golfing aid according to claim 10, wherein the stay member is selectively engageable with different ones of a series of notches in the base member for varying the inclination of the sighting member relative to the base member.

12. The golfing aid according to claim 11, wherein the notches are a series of parallel, transverse notches of the base member, and the stay member engages selectively within one or other of these notches for setting the inclination of the sighting member relative to the base member.

13. The golfing aid according to claim 10, wherein the base member is of elongate form, there are two series of notches spaced apart from one another transversely of the base member, the notches of each series being spaced from one another at intervals lengthwise of the base member, and the stay member has projecting lugs for engagement respectively with notches of the two series for setting the inclination of the sighting member relative to the base member.

14. A golfing for assisting a golfer to detect head-movement during swing of a golf club, the golfing aid comprising:

(a) a base member having a background area and a reference marking located within the background area; and (b) a sighting member hinged to the base member and mounted on the base member for inclination to the base member, the sighting member having an upper surface for viewing by the golfer, the upper surface including a colored region having an aperture therein, and the aperture extending through the sighting member to define a line of sight through the aperture to the reference marking within the background area of the base member;

wherein the reference making is of a first color, the colored region of the upper surface of the sighting member is of the first color, and the background area of the base member is of a second color that is visually-contrasting to the first color to enable the golfer to detect head-movement by observing apparent movement of the second color in the aperture of the sighting member;

selectively-adjustable means for selective adjustment of inclination of the sighting member relative to the base member to vary inclination of the line of sight;

a stay member hinged to the sighting member, the stay member being engageable with the base member for setting inclination of the sighting member relative to the base member, engagement of the stay member with the base member being selectively variable for varying the inclination of the sighting member relative to the base member; and a means for applying a resilient bias urging the stay member into engagement as aforesaid with the base member.

15. A golfing for assisting a golfer to detect head-movement while swing of a golf club, the golfing aid comprising:

(a) a base member having a background area and a reference marking located within the background area; and (b) a sighting member mounted on the base member for inclination to the base member, the sighting member having an upper surface for viewing by the golfer, the upper surface including a colored region having an aperture therein, and the aperture extending through the sighting member to define a line of sight through the aperture to the reference marking within the background area of the base member;

wherein the reference making is of a first color, the colored region of the upper surface of the sighting member is of the first color, and the background area of the base member is of a second color that is visually-contrasting to the first color to enable the golfer to detect head-movement by observing apparent movement of the second color in the aperture of the sighting member;

a stay member hinged to the sighting member, the stay member being engageable with the base member for setting inclination of the sighting member relative to the base member, engagement of the stay member with the base member being selectively variable for varying the inclination of the sighting member relative to the base member; and a means for applying a resilient bias urging the stay member into engagement as aforesaid with the base member.

* * * * *